US005832537A

United States Patent [19]

Wakefield, III

[11] Patent Number: 5,832,537

[45] Date of Patent: Nov. 10, 1998

[54] MULTI-LAYER BILL FOR HEADGEAR WITH SHAPE RETAINING PROPERTIES

[76] Inventor: Franklin W. Wakefield, III, P.O. Box 1044, Morro Bay, Calif. 93443

[21] Appl. No.: 585,634

[22] Filed: Jan. 16, 1996

[51] Int. Cl.[6] ..... A42B 1/06

[52] U.S. Cl. ..... 2/195.1; 2/172; 2/195.6; 2/207

[58] Field of Search ..... 2/171, 172, 195.1, 2/200.1, 207, 10, 12, 195.6

[56] References Cited

U.S. PATENT DOCUMENTS

| | | | |
|---|---|---|---|
| 4,549,316 | 10/1985 | Johnson | 2/195.1 |
| 4,982,449 | 1/1991 | Finkelstein | 2/200.1 |
| 5,253,369 | 10/1993 | Patterson, Jr. | 2/200.1 |
| 5,542,127 | 8/1996 | Bezanis | 2/195.1 |

*Primary Examiner*—Diana Biefeld
*Attorney, Agent, or Firm*—John P. Halvonik

[57] ABSTRACT

An improved flexible bill for caps and other head covering devices is disclosed. The improvement comprising a four layer construction of the bill with upper and lower layers made of a relatively stretchable material such as cotton and with a non-stretchable layer that overlies one of the inner layers. The preferred non-stretchable member is a cotton and rayon blend that is bonded to itself so as to form a relatively non-stretchable layer. The combination of layers allows for folding in one direction only, such as folded upward or folded downward. Lines of stitching going across the bill provide folding lines along which the bill may be folded. The bill may be folded upward along these lines in incremental amounts and the use of the non-stretchable layers enables the bill to retain this folded up shape.

4 Claims, 1 Drawing Sheet

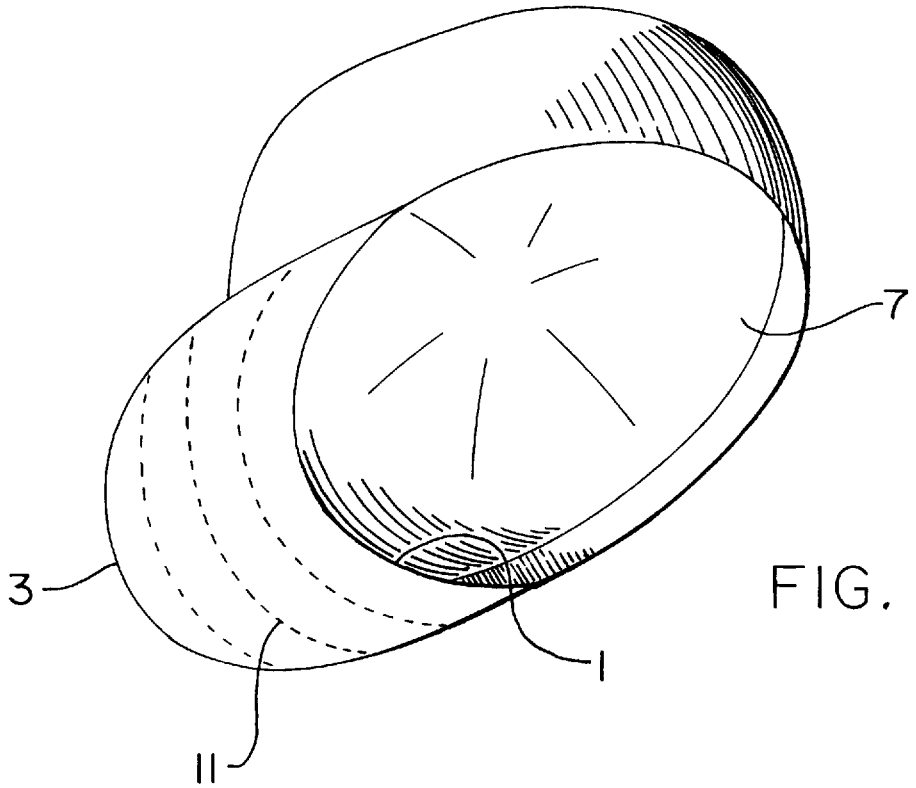
FIG. 1
FIG. 3
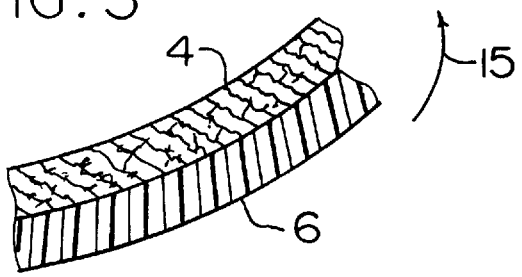
FIG. 2
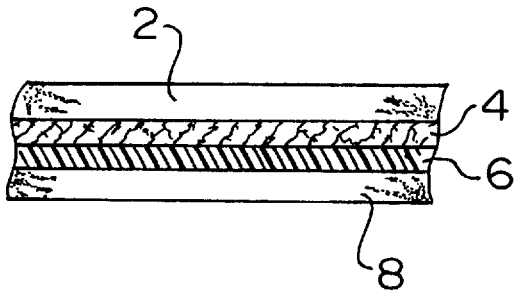

MULTI-LAYER BILL FOR HEADGEAR WITH SHAPE RETAINING PROPERTIES

BACKGROUND AND FIELD OF THE INVENTION

The invention relates to the field of caps and bills and, in particular, to a four layer bill that has a non-stretchable layer comprising at least one of the layers.

It is believed that the improved bill will find its greatest usage in connection with a bandanna attached to one end of the bill so as to cover the user's head. However, the bill may be used with many different kinds of head coverings for example caps. Its greatest advantage appears to lie in the fact that it may be folded in either the upward or downward direction (but not both) in incremental amounts along lines of stitching in the bill. The folded bill retains its folded shape against the elements such as wind, rain, etc. due to the use of stiffening layers in the bill.

DESCRIPTION OF THE PRIOR ART

There are no bills for use in covering the head that have the layered construction that the applicant is aware of.

SUMMARY OF THE INVENTION

The invention is an improved bill having four layers and having an inner, non-stretchable, layer comprising at least one of the four layers. Lines of stitching go across the bill and through all four layers. The lines of stitching provide fold lines that the user may use to fold the bill upward or downward in incremental amounts. The improved bill may be used as the bill for combination bandanna and bill that is the subject of applicant's patent no.: U.S. Pat. No. 5,381,559 issued Jan. 17, 1995. The bill may also find uses in connection with many other types of head coverings.

The preferred non-stretchable material would be a fibrous material layer having fibers that are bonded to themselves in order to form a relatively non-stretchable layer. The other inner layer is more stretchable and may be of felt or neoprene that is of relatively stretchable construction. The use of at least one inner, non-stretchable, layer will enable the bill to be folded in one direction (for example: in the upward direction) and maintain this folded upward shape against the elements such as rain, wind etc. The use of at least one stretchable, inner layer allows the bill to be folded in incremental amounts along one of the fold lines.

It is an object of the invention to provide a stretchable bill that may be folded upward in incremental amounts.

Another object of the invention is to provide a stretchable bill having inner layers comprising a shape retaining material so that the bill may be folded in incremental amounts and retain its folded shape.

Another object of the invention is to provide a bill with inner layers of a relatively non-stretchable material that may be incrementally folded to retain this folded orientation.

Other objectives of the invention will become apparent to those skilled in the art once the invention has been shown and described.

DESCRIPTION OF THE DRAWINGS

FIG. 1 Top view of the bill;

FIG. 2 Cross section of the four layer bill;

FIG. 3 Detail of two inner layers and direction of stretching.

DESCRIPTION OF THE PREFERRED EMBODIMENT

The overall construction of the layers of the bill is shown in FIG. 1. The shape of the bill is as shown in FIG. 1. The rear edge 1 is of relatively curved construction so that it may be attached to a head covering member 7 such as a cap, a hat, a bandanna, etc. The front edge 3 is also of curved construction so that it may form the forward edge of the bill when the bill is attached to a head covering member.

It is preferred that the upper and lower layers should be of any state of the art cloth material. Such materials include: e.g. cotton, polyester, nylon, rayon, silk, hemp, etc. Such material should be relatively attractive in a bill and should also have some weather resistant qualities. It is preferred that the lower layer be made of a woven material e.g. terry cloth as this material has sweat absorbing qualities and is otherwise comfortable to wear when it contacts the skin.

There should be at least two inner layers 4, 6 that are located in between the upper 2 and lower 8 layers. The upper and lower layers are on the outside of the bill and will be exposed to the elements. All of the layers will overlie one another.

One of the inner layers 6 is made of a relatively stretchable material, for example: a pressed, non-woven, polyester felt or, alternately, a thin rubber or neoprene material. This layer overlies the other inner layer (non-stretchable layer), and should be bonded or otherwise attached to it. In the preferred construction, the non stretchable layer will be attached to the upper surface of the stretchable layer. With this construction, the bill will readily fold upward in the direction of arrow 15 and maintain this shape but will resist folding downward, see FIG. 3. If the layers are reversed, i.e the non-stretchable layer on the underside of the stretchable layer, the bill folds downwards but resists upward folding.

The bill may be flipped upward by folding along the lines of stitching 11 and the combination of the stretchable and non-stretchable inner layers allows the bill to be maintained in a folded conformation that is relatively shape-retaining. The use of alternate neoprene material (in the stretchable layer) will decrease the incremental folding characteristic of the bill but it will increase the shape retaining character of the multi-layer bill.

The other inner layer 4 is non-stretchable, or at least less stretchable than the other inner layer, and is preferably made of a fibrous textile material e.g. cotton, rayon, nylon, polyester, etc. The fibers are bonded to one another so as to make this layer relatively non stretchable. Bonding the fibers to one another will reduce the stretchability or elasticity of this layer and prevent it from stretching beyond a certain point. The fibers of the non stretch layer may be woven or non-woven, manmade or natural, fabric and may be bonded together by a chemical process (e.g. by using resins) or by a heating process. This layer may be thinner than the felt layer and should have a stable structure; the fibers may be fixed in place by the resin and/or heat.

It is found that the use of the two inner layers in combination enables to the bill to be incrementally flipped upward and retain this shape against such moderate pressure such as wind, rain, etc.

It is believed that the mechanism that makes the bill retain a folded upward shape is the resistance of the non-stretchable layer to stretching beyond a certain range, i.e. over the relatively stretchable inner layer. The felt and the other layers can stretch, but the bonded material layer resists stretching beyond a certain point. Hence, the non-stretchable layer resists bending in the downward direction in FIG. 3 because it would have to bend over the stretchable inner layer 6 and this require an additional amount of stretch that the non-stretchable layer will resist.

The non-stretchable layer can bend in the upward direction of arrow 15 in FIG. 3 because it doesn't have the additional degree of stretching to go through. Therefore, the bill can be fixed in a bent position but only in one direction: e.g. the upward direction if the non-stretchable layer is on top of the stretchable layer and in the downward direction when the layers are reversed. When the non-stretchable layer is on top, folding upwards does not stretch the bonded layer in the same manner that folding downwards would, hence the bill can be folded upward and retain this shape against moderate pressure but will not retain a folded downward conformation.

All four layers of the bill are divided by lines of stitching 5 running across the width of the bill and relatively parallel to the rear edge. The lines of stitching go all the way through the bill and all of the layers (top, bottom, first and second inner layers). The lines of stitching and the stretchable material allow the user to fold the bill along one of these lines so as to fold the bill in an upward orientation.

Thus when the bill is worn it is initially in a relatively flat orientation but may be flipped upward in incremental amounts along one of the lines of stitching. The user may fold the bill up a large amount or a small amount depending on which of the fold lines (stitching lines) he folds the bill along. The use of the inner non stretch layer facilitates this folding as the relatively non-stretchable layer keeps the bill in a folded-up position. The bill tends to resist the effects of wind etc. that would otherwise tend to cause the bill to return to its original flat orientation. When not folded, the bill will be relatively flat but does not have to be absolutely flat. There may be some curvature to the overall shape of the bill due to the effects of the stitching and relative stiffness of the four layers.

I claim:

1. An improved combination of a head cover and a bill comprising: a bill having a front edge and a back edge, said back edge of curved construction, said bill having at least four layers including top and bottom layers comprising cloth material and having two inner layers, a first inner layer of relatively non-stretchable material positioned adjacent the top layer and a second layer of relatively stretchable material positioned adjacent the bottom layer, said bill having at least two lines of stitching running across said bill and through each of said four layers, said lines of stitching running about parallel to said back edge, said back edge of said bill in connection with said head cover.

2. The apparatus of claim,1 where said head cover is a bandanna.

3. The apparatus of claim 2 wherein one of said inner layers is made of a bonded cotton and rayon blend of material.

4. The apparatus of claim 3 wherein one of said inner layers is made of a pressed polyester felt.

* * * * *